US005082395A

United States Patent [19]

Gustafson

[11] Patent Number: 5,082,395

[45] Date of Patent: Jan. 21, 1992

[54] MOTOR-DRIVEN ROLLERS

[76] Inventor: Adolf G. Gustafson, Musseronvägen 8, S-141 46, Huddinge, Sweden

[21] Appl. No.: 613,590

[22] PCT Filed: May 17, 1989

[86] PCT No.: PCT/SE89/00269

§ 371 Date: Nov. 26, 1990

§ 102(e) Date: Nov. 26, 1990

[87] PCT Pub. No.: WO89/11563

PCT Pub. Date: Nov. 30, 1989

[30] Foreign Application Priority Data

May 18, 1988 [SE] Sweden ..... 8801861

[51] Int. Cl.[5] ..... E01B 19/28; E01B 19/22

[52] U.S. Cl. ..... 404/103; 404/112; 404/101

[58] Field of Search ..... 404/101, 102, 103, 112, 404/114; D4/122

[56] References Cited

U.S. PATENT DOCUMENTS

| | | | |
|---|---|---|---|
| 3,599,543 | 8/1971 | Kerridge | 404/117 |
| 3,949,035 | 7/1976 | Silbernager | 404/98 |
| 3,964,834 | 6/1976 | Paramythioti et al. | 404/84 |
| 4,142,815 | 3/1979 | Mitchell | 404/103 |
| 4,209,988 | 1/1980 | Langworthy et al. | 404/103 X |

FOREIGN PATENT DOCUMENTS

| | | |
|---|---|---|
| 2452394 | 5/1976 | Fed. Rep. of Germany . |
| 2525628 | 12/1976 | Fed. Rep. of Germany . |
| 2638291 | 3/1978 | Fed. Rep. of Germany . |
| 859541 | 1/1961 | United Kingdom . |

*Primary Examiner*—Ramon S. Britts
*Assistant Examiner*—Nancy P. Connolly
*Attorney, Agent, or Firm*—Frishauf, Holtz, Goodman & Woodward

[57] ABSTRACT

The disclosure relates to an arrangement in a motor-driven roller (1) designed with two driving directions, with a yoke (2) or the like for steering the direction of movement of the roller (1).

The arrangement includes a steering device (5) disposed on the yoke (2) or the like and arranged continually to steer the direction of movement of the roller (1). The steering device (5) is placed ahead of the roller (1), seen in the direction of movement of the roller (1), and the steering device (5) for the roller is, in its turn, arranged to be steered by a continually operative steering arrangement (3, 4) so as constantly to determine the direction of movement of the roller (1) and, at the end of the desired movement in one direction, to switch the drive direction of the motor. The steering arrangement (3, 4) is switchably disposed in relation to the surface (6) which is intended to be rolled by means of the motor-driven roller (1).

6 Claims, 1 Drawing Sheet

MOTOR-DRIVEN ROLLERS

The present invention relates to an arrangement in a motor-driven roller operative to be driven in two directions, with a yoke or the like for guiding the direction of movement of the roller.

Motor-driven rollers are previously known in this art. One such prior-art model carries a driver who rides on the roller to steer it. Such rollers give rise to large spot loads and are unsuitable for use on certain types of surfaces, for example on drenched or newly-thawed football pitches. Manually advanced rollers and motor-driven rollers which are manually steered but do not carry a person for steering are employed in the rolling of certain types of surfaces, for example gravel tennis courts, the rolling operation being here performed a very large number of times, for example as many as 30–40 passes. A roller has a very limited operative surface. Consequently, it takes an extremely long time to roll a whole tennis court. Irrespective of whether a motor-driven roller with a pedestrian operator is employed, or whether a roller is pulled manually, one person will be, therefore, constantly occupied in steering the motor-driven roller or in pulling and steering a manual roller. Since such work is boring, calls for considerable exertion and takes a long time—thereby being expensive to carry out—there are difficulties at present in getting such work completed.

The object of the present invention is to propose an arrangement in a motor-driven roller, the arrangement greatly reducing or wholly eliminating at relatively low cost the need of uninterrupted manual steering of the roller.

In the type of roller mentioned by way of introduction, the present invention is characterized by a steering device disposed on a yoke or the like and operative continually to steer the direction of movement of the roller; that this steering device is located ahead of the roller, seen in the direction of movement of the roller; and that the steering device for the roller is in its turn disposed to be steered by a continually operating steering arrangement so as constantly to determine the direction of movement of the roller and, at the end of the desired pass in one direction of movement, to switch the driving direction of the motor, the steering arrangement being switchably disposed in relation to that surface which is intended to be rolled by means of the motor-driven roller.

The nature of the present invention and its aspects will be more readily understood from the following brief description of the accompanying Drawings, and discussion relating thereto.

Figure 1:
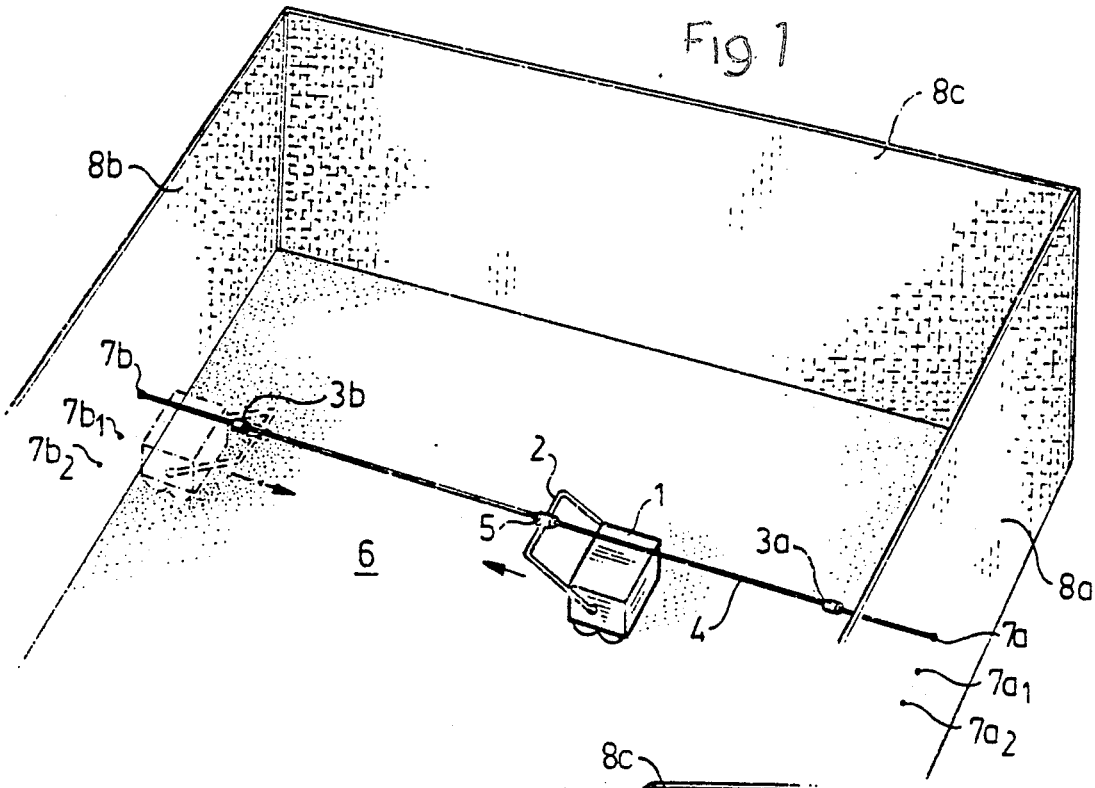
Figure 2:
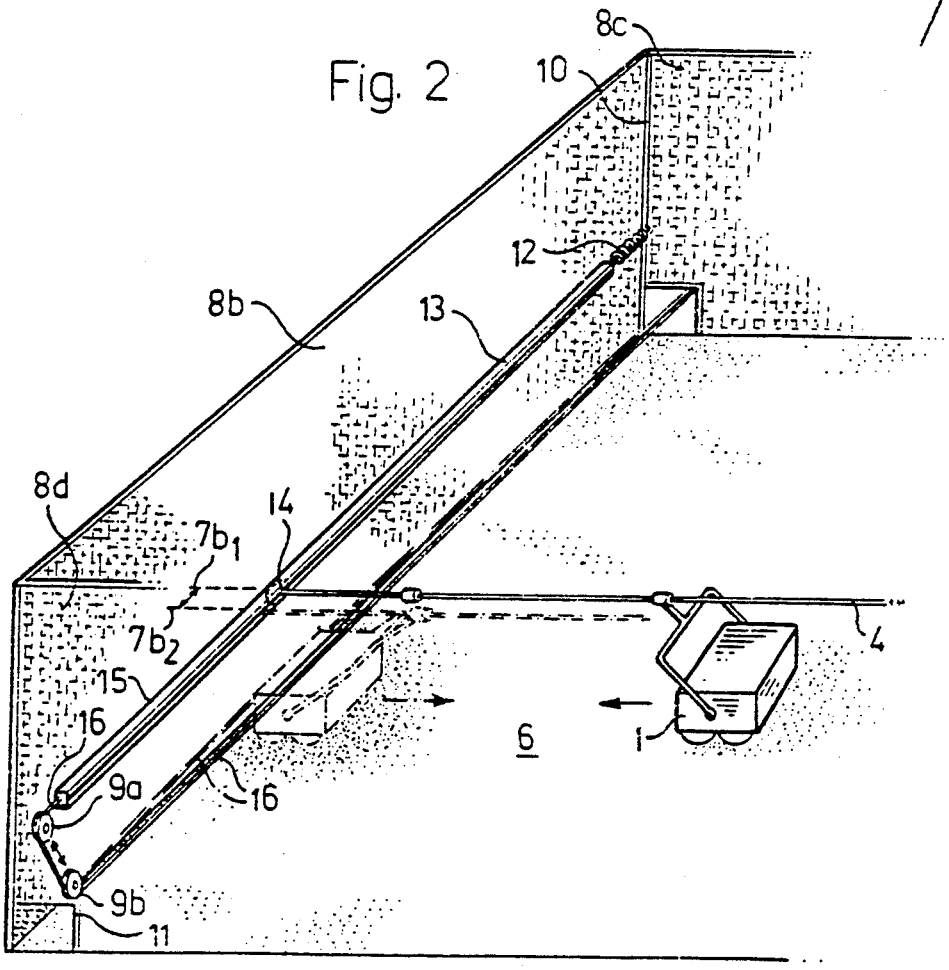

In the accompanying Drawings:

FIG. 1 shows an outdoor tennis court with a so-called gravel surface, in which one embodiment of the present invention is shown in action; and FIG. 2 shows part of a further embodiment of the present invention used on a tennis court with a gravel surface. The same reference numerals have been used on the Drawings for essentially identical details.

Referring to the Drawings, a tennis court surface 6 according to FIGS. 1 and 2 includes a large number of layers of different compositions in the form of gravel, shingle, sand, crushed brick etc. above a drainage system. In order to make the surface playable, compaction of these layers is necessary, since rain water rapidly penetrates through the layers to the drainage system and the water, on its permeation, loosens the layers of the surface. As a rule, such compaction is effected today in that a person manually pulls a roller back and forth across the court a large number of times, for example between 30 and 40 passes, substantially in the same path. Thereafter, the roller is displaced laterally roughly three-quarters of the width of the roller, the roller is then pulled between 30 and 40 passes, and so on, until the entire court has been rolled. It will be readily appreciated that it is an extremely time-consuming and sole-destroying job to roll a complete tennis court. Moreover, complete re-rolling must be carried out after each occasion of rainfall and, after every match, both sweeping and rolling of the court should be carried out, but in such instance the rolling may often be limited in extent.

The rationalization of the above-mentioned rolling procedure which has hitherto been put into effect refers to the utilization of motor-driven rollers with pedestrian operations, but such rollers thus require personnel for steering the roller. Even if the work involved has hereby become less strenuous, there still remains the requirement of manual steering of the roller.

In its simplest embodiment, the present invention comprises, according to FIG. 1, a steering arrangement in the form of for example, a line for consisting, for example, of wire, steel wire, rope, a plastic line or the like, which is fixed at two points 7*a*, 7*b*, for example in the wire fence which as a rule always surrounds a tennis court. At its ends, the line 4 may be provided with simply adjustable and lockable catches (not shown in detail) to be hooked in place in the mesh 8*a* and 8*b* at different points 7*a*, 7*b*; $7a_1$, $7b_1$; $7a_2$, $7b_2$, etc. with a view to progressively rolling the entire court.

As an alternative, a line pair (not shown in FIG. 1) may be provided, with one line on the inside of the mesh 8*a* and running parallel therewith, and the other line on the inside of the mesh 8*b* and running parallel therewith, the ends of the guideline 4 being movably disposed in relation to these lines in a suitable manner, for example with the aid of a step motor which, by means of a further line, alternatingly causes the one point, for example corresponding to 7*a*, to b moved a short distance—corresponding, for example, to more than half a roller width at a time—whereafter the next point, for example corresponding to point 7*b*, is moved the same distance once the desired number of rolling passes has been completed.

The steering arrangement 4, for example the line, is provided a short distance from the mesh 8*a* and 8*b* with switching members 8*a*, 3*b* intended to switch the driving direction of the roller motor. This short distance substantially corresponds to the distance which a yoke 2 or the like projects outside the motor-driven roller 1. The motor-driven roller 1, which may be fitted with, for example, a petrol engine, a battery-powered electric motor etc., may be designed in the customary manner with two mutually rolling rollers, or may be equipped with a large number of rollers as indicated in FIG. 1, or may further be designed in any other appropriate manner, provided that the roller may be driven by the prime mover in question in two mutually opposing directions. In the present case, switching of the driving direction is effected in that the yoke 2 on switching in a manner not shown in detail, actuates, by the intermediary of a switch, the prime mover of the roller 1 to switch driving direction. Switching of the yoke 2 or the like is effected when a catch-formed eye 5 with the line 4 running in the eye 5, or a corresponding steering device disposed and fixed on the yoke 2, strikes a switching member 3*b* which, for example, may consist of a wire or line lock such that the direction of the yoke 2 is reversed.

As will be apparent from FIG. 1, the yoke 2 with the steering device 5 moves ahead of the roller 1, seen in the direction of movement, so as to steer and continually adjust the direction of rolling and movement of the roller 1. Fundamentally, it applies here that the larger the yoke 2 the finer and simpler will be the adjustment of the direction of movement. As opposed to this arrangement, a location of the yoke 2 with the steering device 5 after the roller 1 seen in the direction of movement may result in the steering line 4 being broken by the roller 1 when this is driven obliquely in relation to the line 4.

The above-outlined arrangement operates as follows. The steering device 5 of the roller 1 is connected runningly to the guideline 4 taut between two points 7*a* and 7*b*. The prime mover is started and drives the roller 1—as will be apparent to the right in FIG. 1—to the left, with the yoke 2 and thereby the steering device 5 located ahead of the roller 1 seen in the direction of movement, and compacts the surface 6 of the tennis court by rolling.

When—seen in the left-hand portion of FIG. 1—the steering device 5 strikes the switching device 3*b*, which may consist of a line lock fixedly clamped on the line 4—the roller 1 continues to be driven in the same direction of movement a short distance while the steering device 5 and thereby the yoke 2 are reversed while maintaining contact with the line 4, in which event—as described above—the driving direction of the primer mover is switched and the roller 1 thus changes direction of movement—to the right in FIG. 1. The yoke 2 is once again reversed by the switching device 3*a* in connection with and by the switching device 3*a*, whereafter rolling as above is automatically repeated as many times as are required without manual steering or attendance.

When a portion of the surface 6 which substantially corresponds to the width of the roller 1 has been compacted sufficiently, and when the roller 1 is located close to, for example, the switching device 3*a*, the anchorage of the line 4 on the other side at point 7*b* is manually moved to a new point $7b_1$, whereupon the roller 1 turns and runs along the line 4 now taut between the points 7*a* and $7b_1$. After a suitable number of reciprocal passes, the other end of the line 4 is moved from point 7*a* to point $7a_1$. After a suitable number of reciprocal rolling passes, the one end of the line 4 is moved to point $7b_2$, rolling is effected and the procedure is repeated until the whole court 6 has been compacted to the desired degree.

Rolling of a distance corresponding to the width of the court takes approximately 0.5 minutes and, since the roller 1 must move back and forth between 30 and 40 times, the total time consumption will be approx. 15–20 minutes before the one end of the line is to be moved to a new point, such movement taking but a few seconds, in other words the groundsman is free to carry out other work apart from during the short time required for moving the ends of the line 4 at regular intervals.

Naturally, it is also possible to automate the movements of the ends of the line 4 if such is deemed necessary and economically justifiable, and such an embodiment is shown exclusively by way of example at one end in FIG. 2 and may include sheaves 9*a*, 9*b* anchored to the mesh 8*b* or to a post 11 close to one corner, and a spring 12 in an opposing post 10 close to one corner. A line loop 13 runs from the spring 12 and, in its turn, is coupled to, for example, a slipper block 14 which is self-locking in one direction and is disposed in a box beam 15 open towards the tennis court, the slipper block being advanced stepwise a certain suitable distance in relation to the line when the roller 1 comes into contact with a part 16 of the line loop 13 which thereby places the spring 12 under tension by the intermediary of the sheaves 9*a*, 9*b*, the slipper block 14 being caused to move a short distance in the direction of the arrow, the slipper block 14 once again being blocked. The line 4 which guides the roller I is, at its one end, indirectly connected by the means of the slipper block 14 to the line loop 13, whereby the one end of the line 4 is moved a distance corresponding, for example, to the distance between the points $7b_1$ and $7b_2$ each time the roller 1 comes into contact with the line part 16. In this case, the distance between the points $7b$–$7b_1$; $7b_1$–$7b_2$, etc. being advantageously selected so as to be shorter than that indicated in the foregoing. Movement of the other end of the line 4 may be catered for correspondingly. Hereby, rolling of a whole court may be carried out completely without manual labour input and without manual interference.

Naturally, the steering influence of the line 4 on the roller 1 may be replaced by other suitable means, for example using a number of photocells and reflectors, and switching of the driving direction of the primer mover of the roller may instead be effected by, for example, adapted contact with the mesh 8*a* and 8*b*. Other embodiments of the present invention are also conceivable without departing from the spirit and scope of the appended claims.

What we claim and desire to secure by letters patent is:

1. An arrangement in a motor-driven roller (1) designed with two driving directions, with a yoke (2) for guiding the direction of movement of the roller 1), comprising a steering device (5) disposed on the yoke (2) and operative continually to steer the direction of movement of the roller (1); said steering device (5) being located ahead of the roller (1), as seen in the direction of movement of the roller (1); and said steering device (5) for the roller (1) includes a continually operative steering arrangement for guiding the roller so as to constantly determine the direction of movement of the roller (1) and, at the end of the desired movement in one movement direction, to switch the driving direction, said steering arrangement (3, 4) being switchably disposed in relation to that surface (6) which is intended to be rolled by means of the motor-driven roller (1).

2. The arrangement as claimed in claim 1 wherein said steering arrangement includes a line (4) or the like, taut between two points (7*a*, 7*b*) and two switching members (3*a*, 3*b*) disposed on said line (4) a distance from said two points (7*a*, 7*b*); and said steering device (5) includes an eye-formed catch (5) through which said line (4) runs; and said yoke (2) is when the steering device (5) is in contact with one of said switching devices, (3*a* or 3*b*), switches the driving direction of the motor.

3. The arrangement as claimed in claim 2, wherein each point (7*a*, 7*b*, respectively) is disposed to be manually changeable while the movement of the roller (1) is in progress, in close connection to the second point (7*b*, 7*a*, respectively).

4. The arrangement as claimed in claim 1, wherein said steering arrangement (3, 4) and said points (*7a*, *7b*, respectively), are positioned for an including means for permitting automatic movement after the completed rolling of one portion of said surface (6).

5. The arrangement as claimed in claim 2, wherein said steering arrangement (3, 4) and said points (*7a*, *7b*, respectively), are positioned for and including means for permitting automatic movement after the completed rolling of one portion of said surface (6).

6. The arrangement as claimed in claim 3, wherein said steering arrangement (3, 4) and said points (*7a*, *7b*, respectively), are positioned for and including means for permitting automatic movement after the competed rolling of one portion of said surface (6).

* * * * *

UNITED STATES PATENT AND TRADEMARK OFFICE

CERTIFICATE OF CORRECTION

PATENT NO. : 5,082,395

DATED : January 21, 1992

INVENTOR(S) : Adolf G. GUSTAFSON

It is certified that error appears in the above-identified patent and that said Letters Patent is hereby corrected as shown below:

Title page, Section [56] References Cited:

Under "U.S. Patent Documents", change the USP "3,949,035 7/1976 Silbernager" to

--3,969,035 7/1976 Silbernagel--.

Signed and Sealed this

Thirteenth Day of July, 1993

Attest:

Michael K. Kirk

MICHAEL K. KIRK

Attesting Officer

Acting Commissioner of Patents and Trademarks